US006669889B2

(12) United States Patent
Ohta et al.

(10) Patent No.: US 6,669,889 B2
(45) Date of Patent: Dec. 30, 2003

(54) PROCESS OF MAKING HIGH-STRENGTH POLYETHYLENE FIBERS

(75) Inventors: Yasuo Ohta, Shiga (JP); Godo Sakamoto, Shiga (JP)

(73) Assignee: DSM N.V., Heerlen (NL)

( * ) Notice: Subject to any disclaimer, the term of this patent is extended or adjusted under 35 U.S.C. 154(b) by 334 days.

(21) Appl. No.: 09/727,673

(22) Filed: Mar. 13, 2001

(65) Prior Publication Data

US 2001/0038913 A1 Nov. 8, 2001

Related U.S. Application Data

(63) Continuation of application No. PCT/JP99/02766, filed on May 26, 1999.

(30) Foreign Application Priority Data

Jun. 4, 1998 (JP) ..... 10-156218
Mar. 18, 1999 (JP) ..... 11-074209

(51) Int. Cl.[7] ..... D01D 5/12
(52) U.S. Cl. ..... 264/210.8
(58) Field of Search ..... 264/176.1, 210.8

(56) References Cited

U.S. PATENT DOCUMENTS 5,443,904 A * 8/1995 Ohta et al. ..... 428/364

OTHER PUBLICATIONS

English Abstract of JP 1–156,508 A (Jun. 20, 1989).

English Abstract of JP 1–162,819 A (Jun. 27, 1989).

* cited by examiner

*Primary Examiner*—Leo B. Tentoni
(74) *Attorney, Agent, or Firm*—Pillsbury Winthrop LLP

(57) ABSTRACT

The invention relates to high-strength polyethylene fibers of mainly ethylene component having an intrinsic viscosity [η], when fibrous, of no less than 5, and having a strength of no less than 20 g/d and an elasticity modulus of no less than 500 g/d, and, in the measurement of the temperature variance of the dynamic viscoelasticity of the fibers, the γ dispersion loss modulus peak temperature is no greater than −110° C. and the loss tangent (tan δ) is no greater than 0.03. The invention further relates to a method for producing high strength polyethylene fibers, wherein a polymerization mixture containing from 99 to 50 parts by weight of (A) and from 1 to 50 parts by weight of (B), where (A) is high molecular weight polymer of mainly ethylene component and having a weight average molecular weight to number average molecular weight ratio (Mw/Mn) of no greater than 4 and an intrinsic viscosity [η] of no less than 5, and (B) is an ultrahigh molecular weight polymer having an intrinsic viscosity at least 1.2 times that of high molecular weight polymer (A), is dissolved in solvent to a concentration of from 5% by weight to 80% by weight, then spun and drawn.

4 Claims, No Drawings

PROCESS OF MAKING HIGH-STRENGTH POLYETHYLENE FIBERS

This is a continuation of Application No. PCT/JP99/02766, filed May 26, 1999.

TECHNICAL FIELD

The present invention relates to high-strength polyethylene fibres which can be used in a wide range of fields, as various ropes, fishing lines, netting and sheeting for engineering, construction and the like, cloth and nonwoven cloth for chemical filters and separators, sportswear and protective clothing such as bulletproof vests, or as reinforcing material for composites for sport, impact-resistant composites and helmets, and particularly as various industrial materials used at from extremely low temperatures to room temperature; where the performance of said fibres, particularly the mechanical properties such as strength and elastic modulus, undergo little variation with temperature during use in environments subject to large changes in temperature; and the present invention relates to a method for producing said fibres sufficiently quickly industrially.

BACKGROUND TECHNOLOGY

In recent years, active attempts have been made to obtain high-strength, high-elastic modulus fibres from ultrahigh molecular weight polyethylene starting material, and extremely high strength/elastic modulus fibres have been reported. For example, Japanese Unexamined Patent Application S56-15408 discloses a technique known as the "gel spinning method", where gel-like fibres obtained by dissolving ultrahigh molecular weight polyethylene in solvent are drawn to a high draw ratio.

It is known that the high strength polyethylene fibres obtained by the "gel spinning method" are very high in strength and elastic modulus as organic fibres, and are also highly superior in terms of impact resistance, and these fibres are being evermore widely used in various fields. The abovementioned Japanese Unexamined Patent Application No. S56-15408 discloses that it is possible to provide a material having extremely high strength and elastic modulus, in order to obtain such high strength fibres. However, it is known that high strength polyethylene fibres undergo major changes in performance with temperature. For example, measuring the tensile strength while varying the temperature from about −160° C. reveals a gradual decrease as the temperature increases, and that decrease in performance is particularly marked at from −120° C. to around −100° C. With regard to temperature-related performance, then, it is anticipated that the performance of conventional high-strength polyethylene fibres could be considerably improved if their physical properties at extremely low temperatures could be maintained at room temperature.

Conventional attempts to control changes in the mechanical properties of high-strength polyethylene fibres due to changes in temperature include an attempt to improve the vibration absorption at temperatures not greater than −100° C. (referred to as the extremely low temperature region) by using a suitable ultrahigh molecular weight polyethylene starting material of a specific molecular weight and keeping the molecular weight of the resulting fibres within a suitable range, as disclosed in Japanese Unexamined Patent Application No. H7-166414, but, fundamentally, that technique increases the mechanical dispersion at extremely low temperature. Specifically, it attempts to increase the variation in elastic modulus, whereas the present invention aims to lessen the deterioration in mechanical properties.

Japanese Unexamined Patent Application Nos. H1-156508 and H1-162816 disclose attempts to reduce the creep in high-strength polyethylene fibres by means such as ultraviolet irradiation and peroxides, in the abovementioned gel spinning method. It is noted that, fundamentally, this does decrease the mechanical dispersion in γ dispersion as described above, which is described in the present invention as desirable, but both inventions aim to improve the creep of high-strength polyethylene fibres, but do not decrease the variation in mechanical properties due to changes in temperature. Specifically, if the relaxation strength in the γ dispersion is smaller, the temperature at which the relaxation occurs is usually shifted higher, and so as it is desirable in the present invention to decrease the variation in mechanical properties that occur on changes in temperature, that is, to shift the γ dispersion temperature to a lower temperature, the conventional methods are contrary to the aim of the present invention.

Specifically, it is suggested that having a small γ dispersion value for γ dispersion temperatures in the range no greater than −100° C., as relaxation strength, while keeping the temperature region therefor at very low temperatures allows the good physical properties (especially strength) seen in the very low temperature region to be maintained without relaxation even for long periods at temperatures around room temperature, and such fibres would be extremely useful industrially. Fibres having such novel properties could, as described below, be substituted for conventional high-strength polyethylene fibres with no loss of the fundamental merits which said conventional fibres should have; moreover, as they are high-strength fibres, it is anticipated that they could also be drawn at extremely high speed during production processes and particularly during drawing processes. That is to say, this also has industrial significance as a novel production method which can yield high-strength polyethylene fibres of excellent performance at higher productivity.

In view of the situation described above, the present invention aims to provide high-strength polyethylene fibres characterized in that they have excellent mechanical properties at normal temperatures, and in that the mechanical properties such as strength and elasticity modulus seen on wide temperature variation, particularly in the liquid nitrogen temperature region, are maintained at a high level even at room temperature; and a novel production method therefor.

DISCLOSURE OF THE INVENTION

The first invention of the present invention provides high-strength polyethylene fibres characterized in that they are polyethylene fibres comprising mainly ethylene component having an intrinsic viscosity [η], when fibrous, of no less than 5, and have a strength of no less than 20 g/d and an elasticity modulus of no less than 500 g/d, and, in the measurement of the temperature variance of the dynamic viscoelasticity of the fibres, the γ dispersion loss modulus peak temperature is no greater than −110° C. and the loss tangent (tan δ) is no greater than 0.03.

The second invention of the present invention provides high-strength polyethylene fibres, characterized in that, in the measurement of the temperature variance of the dynamic viscoelasticity of the fibres, the γ dispersion loss modulus peak temperature is no greater than −115° C.

The third invention of the present invention provides high-strength polyethylene fibres, characterized in that, in the measurement of the temperature variance of the dynamic viscoelasticity of the fibres, the γ dispersion loss tangent (tan δ) is no greater than 0.02.

The fourth invention of the present invention provides high-strength polyethylene fibres, characterized in that, in the measurement of the temperature variance of the dynamic viscoelasticity of the fibres, the crystalline α dispersion loss modulus peak temperature is no less than 100° C.

The fifth invention of the present invention provides high-strength polyethylene fibres, characterized in that, in the measurement of the temperature variance of the dynamic viscoelasticity of the fibres, the crystalline α dispersion loss modulus peak temperature is no less than 105° C.

The sixth invention of the present invention provides high-strength polyethylene fibres, characterized in that they have a strength of no less than 25 g/d and an elasticity modulus of no less than 800 g/d.

The seventh invention of the present invention provides high-strength polyethylene fibres, characterized in that they have a strength of no less than 35 g/d and an elasticity modulus of no less than 1200 g/d.

The eighth invention of the present invention provides a method for producing high-strength polyethylene fibres, characterized in that a polymerization mixture comprising from 99 to 50 parts by weight of (A) and from 1 to 50 parts by weight of (B), where (A) is high molecular weight polymer comprising mainly ethylene component and having a weight average molecular weight to number average molecular weight ratio (Mw/Mn) of no greater than 4 and an intrinsic viscosity [η] of no less than 5, and (B) is an ultrahigh molecular weight polymer having an intrinsic viscosity at least 1.2 times that of high molecular weight polymer (A), is dissolved in solvent to a concentration of from 5% by weight to 80% by weight, then spun and drawn.

The ninth invention of the present invention provides a method for producing high-strength polyehtylene fibers, characterized in that the high molecular weight polymer (A) is an polyethylene polymer comprising mainly ethylene component having a weight average molecular weight to number average molecular weight ratio (Mw/Mn) of no greater than 2.5 and an intrinsic viscosity [η] of from 10 to 40.

The tenth invention of the present invention provides a method for producing high-strength polyethylene fibres, characterized in that the average intrinsic viscosity [η]M of the polymerization mixture is no less than 10 and the intrinsic viscosity [η] F of the resulting fibres satisfies the formula below $$0.6\times[\eta]M \leqq [\eta]F \leqq 0.9\times[\eta]M$$

The eleventh invention of the present invention provides a method for producing high-strength polyethylene fibres, characterized in that the intrinsic viscosity [η] F of the resulting fibres satisfies the formula below $$0.7\times[\eta]M \leqq [\eta]F \leqq 0.9\times[\eta]M$$

The working mode of the present invention is described below.

The high molecular weight polyethylene of the present invention is characterized in that its repeat unit is essentially ethylene, although it may be a copolymer thereof with small amounts of other monomers such as α-olefin, acrylic acid or derivatives thereof, methacrylic acid or derivatives thereof or vinyl silane or derivatives thereof, or it may be a copolymer with these, or a copolymer with ethylene homopolymer, or it may be a blend with homopolymers of other α-olefins and the like. The use of a copolymer with an α-olefin such as propylene or butene-1 is particularly preferred in that a degree of short or long chain branching imparts stability during the production of these fibres, particularly during spinning and drawing. However, too high a content of components other than ethylene has an adverse effect on drawing, and so in order to obtain fibres of high strength and high elasticity modulus, the monomer unit content should be no greater than 5 mol %, and is preferably no greater than 1 mol %. Obviously, homopolymer comprising ethylene alone may be used.

The characterizing feature of the present invention is, in essence, the provision of fibres characterized in that, in the temperature variance of the dynamic viscoelasticity properties measured when fibrous, the γdispersion loss modulus peak temperature is no greater than −110° C., preferably no greater than −115° C., and the value of the loss tangent thereof (tan δ) is no greater than 0.03, preferably no greater than 0.02, and that the crystalline α dispersion loss modulus peak temperature is not less than 100° C., preferably not less than 105° C. The present invention also provides a method for obtaining fibres having these properties, that is, a method for producing high-strength polyethylene capable of essentially high speed drawing, at far higher productivity than conventional methods for producing the same kind of fibres.

The decrease in the temperature-dependent variation in the properties of the inventive fibres, particularly the excellent mechanical properties (particularly strength) at room temperature, can be defined in terms of the fibres' dynamic viscoelastic crystalline α dispersion peak temperature and γ dispersion peak temperature. Specifically, a marked decrease in elasticity modulus is usually seen in the temperature region in which mechanical dispersion occurs. In the case of high-strength polyethylene fibres, γ dispersion is usually observed around −100° C. At and beyond the limits of this γ dispersion, the physical values of polyethylene decrease markedly as the temperature is increased towards room temperature. For example, polyethylene fibres which are very strong (4 GPa) in an extremely low temperature atmosphere obtained using liquid nitrogen or the like (approximately −160° C.) are less strong (their strength decreases to approximately 3 GPa) when measured at room temperature. Such an effect is obviously undesirable in products which involve the use of said fibres in wide temperature ranges, and it is thought that if this phenomenon could be improved upon, it would be possible to drastically improve strength at room temperature.

Moreover, high-strength polyethylene fibres exhibit a crystalline α dispersion at around 85° C., and even in this temperature region there is considerable variation in elastic modulus and strength, which is undesirable for various products. Accordingly, in order to allow a certain margin, the temperature range for the use of these fibres is usually decided by setting a temperature range between the γ dispersion temperature and the crystalline αdispersion temperature.

The lowering of the γ dispersion temperature and the raising of the crystalline αdispersion temperature is therefore highly significant in that it widens the abovementioned temperature range for use.

The γ dispersion is the first point scrutinized when aiming to develop new fibres based on this ideal design, and it is known that this γ dispersion originates from local defects at side chains, terminals and the like in the molecules which make up the fibres. Decreasing the number of defects would decrease the γdispersion relaxation strength (that is, the loss tangent (tan δ)), but this would usually result in a more perfect fibre-fine structure, and so the temperature at which γ dispersion occurs would automatically shift to a higher temperature. Moreover, the crystalline α dispersion peak temperature in the present fibres is very high (at least 100° C. or more, preferably 105° C. or more) compared to that of conventional high-strength polyethylene fibres obtained by the abovementioned means such as drawing (which is at most 95° C.). Furthermore, even if the abovementioned fibres which have a high crystalline αdispersion are excluded, it is difficult to achieve a temperature lower than −110° C. in γ dispersion for highly crystalline fibres which usually have a crystalline α dispersion temperature of at least 90° C. Some fibres, for example those having a crystalline α dispersion temperature of around 85° C., do exhibit γ dispersion temperatures at or lower than −110° C., but this is because their fibre structure has become more amorphous, and such fibres are clearly distinguishable from the novel fibres targeted by the present invention, which have a high crystallinity (a high crystalline α dispersion temperature) and a low γ dispersion temperature.

Contrary to conventional technology, it is absolutely impossible to decrease the relaxation strength while the γ dispersion peak temperature is kept low. Given conventional common-sense, it is extremely surprising that the γ dispersion peak temperature in the fibres provided by the present invention is kept very low and that the value thereof is extremely small.

The means for obtaining the fibres of the present invention is necessarily a novel and cautious method. Moreover, the means described below provides high-strength polyethylene fibres of the present invention which also have the general characteristics of conventional high-strength polyethylene and so said means is also valuable industrially as a novel production method for these which achieves very high productivity.

The fibres of the present invention are obtained efficiently in practice by the abovementioned "gel spinning method", although provided that ultrahigh molecular weight polyethylene is moulded to yield known high-strength polyethylene fibres, any standard spinning technique may be used. The starting material polymer is of first importance in the present invention.

Specifically, the present invention recommends the use of a polymerization mixture of at least two types of ultrahigh molecular weight polyethylene, comprising from 99 to 50 parts by weight of (A) and from 1 to 50 parts by weight of (B), where (A) is high molecular weight polymer comprising mainly ethylene component having a weight average molecular weight to number average molecular weight ratio (Mw/Mn) of no greater than 4 and an intrinsic viscosity [η] of no less than 5, and (B) is an ultrahigh molecular weight polymer having an intrinsic viscosity at least 1.2 times that of high molecular weight polymer (A). Above all, polymer (A) should have an intrinsic viscosity of no less than 5, preferably no less than 10, but not more than 40, and the Mw/Mn of the polymer, measured by GPC (gel permeation chromatography), should be no greater than 4, preferably no greater than 3, and more preferably no greater than 2.5.

First, in order to achieve the inventive low value for the γ dispersion temperature, it is necessary to select a substance with as few defects as possible on the branches, terminals and the like, and so the degree of polymerization of the main polymer (A) is important, and if the intrinsic viscosity is less than 5, the molecular terminals increase considerably and the γ dispersion tan δ value increases. If it exceeds 40, however, the viscosity of the solution becomes too great during spinning and spinning becomes difficult. Here, the average molecular weight (which represents intrinsic viscosity) and the distribution thereof, that is, the molecular weight distribution, are very important, and the Mw/Mn (measured by GPC) is preferably no greater than 4. By using a starting material which has an ultrahigh molecular weight and has a relatively uniform molecular weight distribution, it is easy to maintain a low γ dispersion temperature and have a low tan δ value thereof.

The reason for this is not well understood, although it is speculated that when the molecular chain is made uniform, crystals (thought to be formed by the extending of the chains) cause the molecules to line up and become oriented, and so there are very few molecular terminals in the crystalline region, and the molecular terminals collect and remain in the so-called amorphous region. That is, it is speculated that the crystalline region, which makes up most of the inventive fibre structure, becomes more perfectly crystalline, with fewer defects, and the components such as molecular terminals concentrate in the amorphous region. This corresponds with the scientifically known fact that if the crystalline region contains many defects (which dictate the γ dispersion), the peak temperature will shift to a higher temperature, and with the fact that there are few local regions of molecular terminals and the like in the crystalline part of fibres of the present invention. As the main structure of the inventive fibres is a crystalline structure comprising extended chains, it is thought that the molecular terminals concentrate in the amorphous part and do not particularly affect physical properties, although this is a hypothesis contrived to explain the effects of the present invention and is not certain.

Thus by merely using an ultrahigh molecular weight polyethylene polymer having an extremely narrow molecular weight distribution in a common spinning method, stable discharge cannot be achieved during spinning because the molecular weight distribution of the starting material polymer is very narrow, and the discharged solution has almost no extendability and so moulding it is impossible in practice. The molecular weight distribution Mw/Mn should at least be greater than 4 when an abovementioned polymer is supplied to a conventional gel spinning method. An example of an attempt to use such a low molecular weight polymer is disclosed in Japanese Unexamined Patent Application No. H9-291415, wherein high strength, high elasticity modulus fibres are obtained using an ultrahigh molecular weight polyethylene-based polymer that is prepared using a special catalyst and has a viscosity average molecular weight of no less than 300,000 and an Mw/Mn ratio of no greater than 3. According to said publication, the technique disclosed therein is commonly employed, rather than the gel spinning method which is commonly used to produce high-strength polyethylene fibres; said disclosed technique involves a combination of solid phase extrusion and gel extension using a dry simple crystal aggregate reagent, where said simple crystal aggregate is obtained by dissolving polymer to a dilute solution of a concentration of no more than 0.2 wt %, and technology involving the use of a simple crystal aggregate is also disclosed in the working example. As shown in this example, it is extremely difficult to perform spinning and drawing processes using the low Mw/Mn polymer of the conventional gel spinning method. Needless to say, the general properties and physical properties of the gel drawn films made from the very dilute solutions disclosed in said publication are different from those of the novel fibres provided by the present invention.

The reason why it is difficult to mould such polymers having a very narrow molecular weight distribution is perhaps that the intertwining of molecular chains is drastically reduced as a result of the narrow molecular weight distribution, and so the stress required to deform the molecular chains during spinning and drawing cannot be uniformly transmitted, although this is merely speculation. With this in mind, diligent research was performed into improving conventional technology, and the present invention was achieved on discovering that the use of a mixture comprising from 99 to 50 parts by weight of polymer (A) (main component) and from 1 to 50 parts by weight of ultrahigh molecular weight polymer (B) having an intrinsic viscosity that is at least 1.2 times that of polymer (A) greatly facilitates spinnability (facilitates take-up when the solution discharged from the spinneret is drawn) and drawing, and markedly improves drawing speed, and the resulting fibres have the required properties described above, that is, the dispersion temperature is low and tan δ is low. Furthermore, in the present invention, by using a mixture in which the average intrinsic viscosity [η]M of the polymers therein is not less than 10, and by dissolving the polymer in solvent so that it comprises from 5% by weight to 80% by weight of the total, and spinning and drawing under production conditions so that the intrinsic viscosity [η]F of the resulting fibres satisfies the equation below, it is possible to obtain fibres having physical properties that are remarkably close to those desired:

$$0.6\times[\eta]M \leqq [\eta]F \leqq 0.9\times[\eta]M$$

preferably, $$0.7\times[\eta]M \leqq [\eta]F \leqq 0.9\times[\eta]M$$

It is not certain how this relationship between the molecular weight of the starting material polymers and the resulting fibres affects the physical properties of the fibres, but if the intrinsic viscosity [η]F of the fibres exceeds 90% of [η]M, the two different molecular weight polymers do not uniformly mix and extendability is extremely poor, whereas if [η]F is less than 70% of [η]M, mixing two polymers has almost no effect and it is only possible to achieve more or less the same physical properties as seen in high strength polyethylene fibres in which the molecular weight distribution is as wide as usual. A large difference between the degree of polymerization of the resulting fibres and the starting material polymer means that the molecular chains break during processing, and the molecular weight distribution has to be somehow readjusted. It has been suggested that at this time the polymer of high molecular weight within the mixture often deteriorates more, and that by adjusting the molecular weight distribution of the whole so that this high molecular weight matter is incorporated in the low molecular weight matter molecular weight distribution region, a smoother molecular sequence is obtained, and, as the residual high molecular weight component fulfils its role of spreading tension during moulding, both mouldability and workability during spinning and drawing are achieved, although this is speculation and has not been confirmed.

Fibres obtained by the abovementioned methods have an intrinsic viscosity [η]F, when fibrous, of no less than 5, preferably from 10 to 40, a strength of no less than 20 g/d, preferably no less than 25 g/d, and more preferably no less than 35 g/d, and an elastic modulus of no less than 500 g/d, preferably no less than 800 g/d, more preferably no less than 1200 g/d, and, as a result of synergistic effects with mechanical dispersion properties as described above, it is possible to provide polyethylene fibres of excellent properties for practical use, which are not known conventionally.

OPTIMUM MODE OF THE PRESENT INVENTION

The present invention is described below by means of working examples, but the present invention is not limited to these.

The measurement methods and measurement conditions for the property values in the present invention are described first.

Dynamic Viscoelasticity Measurement

In the present invention, dynamic viscosity was measured using a Rheoviblon DDV-01FP, manufactured by Orientec. The fibres as a whole were divided or doubled to have 100 denier±10 denier, and while the respective fibres were arranged as uniformly as possible, both the terminals of the fibres were enclosed with aluminium foils such that the measurement length (distance between the chuck ends) was 20 mm, and the fibres were adhesive-bonded with a cellulose type adhesive. The length of the margin left for applying the adhesive was made around 5 mm to allow fixing of the chuck. Each test sample was set carefully on the chuck at an initial width of 20 mm to prevent the strand from being entwined or twisted around it, then the fibres were subjected to preliminary deformation for a few seconds at a temperature of 60° C. and a frequency of 110 Hz. In this experiment, the temperature distribution was determined at a frequency of 110 Hz in the range of from −150° C. to 150° C., increasing the temperature from −150° C. at a rate of approximately 1° C./min. During measurement, the stationary load was set at 5 gf and the sample length was automatically controlled to prevent the fibres from loosening. The dynamic deformation amplitude was set at 15 μm.

Strength/Elastic Modulus

In the present invention, the strength and elastic modulus of a 200 mm-long sample were determined using Tensilon, manufactured by Orientec, at a draw rate of 100%/min, and the distortion-stress curve was obtained at an atmospheric temperature of 20° C. and 65% relative humidity; the stress (g/d) at the break point in the curve was determined, and the elastic modulus (g/d) was calculated from the tangent of the line giving the maximum slope in the vicinity of the origin of the curve. Each value was the average of 10 measurements.

Intrinsic Viscosity

The relative viscosities of various dilute solutions in decalin at 135° C. were measured using an Ubbellohde type capillary viscosity tube, and the intrinsic viscosity was determined from the extrapolation point towards the origin of the straight line obtained by least square approximation of plots of viscosities against concentration. For these measurements, if the starting material polymer was powdery it was used in that form without further modification, whereas in the case of lumpy powder or fibrous samples, solutions for measurement were prepared by dividing or cutting the samples to approximately 5 mm in length, adding antioxidant (Yoshinox BHT, manufactured by Yoshitomi Seiyaku) at 1 wt % with respect to the polymer, then dissolving with agitation for 4 hours at 135° C.

Molecular Weight Distribution Measurement

For this patent, Mw/Mn was measured by the gel permeation chromatography method. Measurements were made at a temperature of 145° C. using a 150C ALC/GPC instrument manufactured by Waters, and GMHXL series column manufactured by Tosoh (K.K.). The calibration curve for the molecular weight was obtained using a polystyrene high molecular weight calibration kit manufactured by Polymer Laboratories. The sample solutions used were obtained by dissolving in trichlorobenzene to 0.02 wt %, adding antioxidant (Irgafos 168, manufactured by Ciba Geigy) at 0.2 wt % of the polymer, then dissolving for approximately 8 hours at 140° C.

The present invention is described in detail below.

WORKING EXAMPLE 1

A powder mixture comprising 99 parts of homopolymer (A) of ultrahigh molecular weight polyethylene having an intrinsic viscosity of 18.5 and a molecular weight distribution index Mw/Mn of 2.5 and 2 parts by weight of polymer (D) having an intrinsic viscosity of 28.0 and a molecular weight distribution Mw/Mn of approximately 5.5 was taken, and 70% by weight of decahydronaphthalene was added at normal temperature so that said mixture made up 30% by weight of the total. At this time, the intrinsic viscosity [η]M of the polymer mixture was 18.8. A decalin dispersion of this mixed polymer was supplied to a twin-screw mixer/extruder and dissolved and extruded at 200° C. and 100 rpm. It should be noted that antioxidant was not used at that time.

Solution prepared in this way was extruded using a spinneret provided with 48 holes of orifice 0.6 mm in diameter such that the output from each hole was 1.2 g/min, then part of the solvent was immediately removed using inert gas adjusted to room temperature, and the sample was taken off at a rate of 90 m/min. Immediately after having been taken off, the polymer content of the gel-like fibres was 55% by weight. This yarn that had been taken off was immediately drawn 4-fold in a 120° C. oven, then wound once, then further drawn 4.5-fold in an oven adjusted to 149° C., to yield high-strength fibres. The various physical properties, including the dynamic viscoelasticity, of the resulting fibres are shown in Table 1.

WORKING EXAMPLE 2

Spun yarn was obtained by the same operations as in Working Example 1, except that polymer having an intrinsic viscosity of 12.0 was used as the main component polymer. At this time, the intrinsic viscosity [η]M of the polymer mixture was 10.6. Drawing was much smoother than in Working Example 1, but the strength of the resulting fibres was slightly lower.

WORKING EXAMPLE 3

The proportion of the main component polymer of Working Example 1 and the added polymer was adjusted to 90 parts by weight: 10 parts by weight, then spun yarn was obtained by the same operations. At this time, the intrinsic viscosity [η]M of the polymer mixture was 19.5. The second drawing was slightly awkward and the draw ratio had to be dropped to 4-fold, and as a result the strength and elasticity modulus and the like were lower, although it was possible to obtain fibres having physical properties which were satisfactory overall.

WORKING EXAMPLE 4

An experiment was performed which involved obtaining spun yarn by the same operations as in Working Example 1, except that when the polymer was dissolved, antioxidant (trade name Yoshinox BHT, manufactured by Yoshitomi) was added at 1 wt % with respect to the total amount of blend polymer. The spinning speed was increased to an upper limit of 30 m/min, and thereafter relatively stable drawing was possible. The properties of the resulting fibres were compared with those achieved in Working Example 1, and although the elasticity in particular was lower, overall satisfactory results were obtained.

WORKING EXAMPLE 5

Fibres were obtained by the same operations as in Working Example 1, except that polymer having an intrinsic viscosity of 18.2 obtained by copolymerizing 1-octene at 0.1 mol % with respect to ethylene was used as the main component polymer. It should be noted that the intrinsic viscosity of the mixture was 18.5. the elasticity of the fibres tended to be slightly lower than those obtained in Working Example 1, although when it came to spinning, the spinnability and the workability on extension and the like were superior. The dynamic viscoelasticity was also excellent.

COMPARATIVE EXAMPLE 1

Only the main component polymer of Working Example 1 was used, and no high molecular weight material was added. Spinning resulted in immediate serious yarn breakage and it was impossible to pick up satisfactory fibres.

COMPARATIVE EXAMPLE 2

0.2% by weight of main component polymer (A) used in Working Example 1 were taken, antioxidant (trade name Yoshinox BHT, manufactured by Yoshitomi) was added to 1 wt % with respect to the polymer, and these were dissolved uniformly in decalin, then casting was performed on a flat surface glass plate which was then left naturally overnight, then the solvent was completely evaporated off by leaving the system in a vacuum at 80° C. over 2 nights, to yield an approximately 15 micron thick cast film. This was drawn 4-fold at 50° C., 3-fold at 120° C. and then 2-fold at 140° C. to a total of 24-fold at a distortion speed of approximately 10 mm/min using a tension tester with provision for high temperatures, to yield a highly oriented film. The strength of the resulting film, calculated as (g/d) is shown in Table 1. The dynamic viscoelasticity of the film was measured by measuring according to the measurement method for fibres corresponding to the dimensions and thickness of the sample, then performing final correction to the actual thickness. The properties of the resulting film were such that it had sufficient high strength and high elasticity modulus. Specifically, the elasticity modulus was particularly excellent, as seen from the high draw rate. As for its dynamic viscoelasticity, although the γ dispersion value was low, its peak temperature shifted to an extremely high temperature and it was impossible to achieve the desired physical properties.

COMPARATIVE EXAMPLE 3

Drawn yarn was obtained by the same operations except that polymer having an intrinsic viscosity of 18.8 and a molecular weight distribution index Mw/Mn of 8.5 was used instead of the main component polymer used in Working Example 1. It should be noted that the average intrinsic viscosity of the blend was 18.9. the yarn extendability was less than that achieved in Working Example 1 and it was necessary to decrease the draw ratio slightly, and so the strength was lower. As for the dynamic viscoelasticity, the γ dispersion loss modulus peak value temperature was good, at −116° C., although the loss tangent was a high value, at 0.040.

INDUSTRIAL USES

It is possible to provide high-strength polyethylene fibres which can be used in a wide range of fields, as various ropes, fishing lines, netting and sheeting for engineering, construction and the like, cloth and nonwoven cloth for chemical filters and separators, sportswear and protective clothing such as bulletproof vests, or as reinforcing material for composites for sport, impact-resistant composites and helmets, and particularly as various industrial materials used at from extremely low temperatures to room temperature; where the properties of the fibres change very little with temperature variation and where said high-strength polyethylene fibres have excellent mechanical properties at normal temperature. It is also possible to provide a method for producing these high-strength polyethylene fibres with sufficiently quickly speed industrially.

TABLE 1

| Experiment | [η]B (g/dl) | [η]F (g/dl) | Draw rate | Strength (g/d) | Elasticity modulus (g/d) | γ dispersion temperature (° C.) | tan δ (–) | Crystalline α dispersion temperature (° C.) |
|---|---|---|---|---|---|---|---|---|
| Working Example 1 | 18.8 | 15.2 | 18 | 43.1 | 1557 | −114 | 0.021 | 110 |
| Working Example 2 | 12.7 | 10.3 | 18 | 32.5 | 1025 | −119 | 0.028 | 105 |
| Working Example 3 | 19.6 | 16.3 | 16 | 45.2 | 1533 | −112 | 0.025 | 112 |
| Working Example 4 | 18.8 | 17.2 | 18 | 34.6 | 918 | −111 | 0.029 | 107 |
| Working Example 5 | 18.2 | 18.5 | 18 | 41.1 | 1235 | −116 | 0.024 | 108 |
| Comparative Example 1 | 18.5 | — | — | — | — | — | — | — |
| Comparative Example 2 | 18.5 | 17.8 | 240 | 44.7 | 1905 | −98 | 0.022 | 95 |
| Comparative Example 3 | 18.9 | 15.5 | 17.5 | 33.5 | 1103 | −116 | 0.040 | 83 |

What is claimed is:

1. Method for producing high-strength polyethylene fibres, characterized in that a polymerization mixture comprising from 99 to 50 parts by weight of (A) and from 1 to 50 parts by weight of (B), where (A) is high molecular weight polymer comprising mainly ethylene component and having a weight average molecular weight to number average molecular weight ratio (Mw/Mn) of no greater than 4 and an intrinsic viscosity [η] of no less than 5, and (B) is an ultrahigh molecular weight polymer having an intrinsic viscosity at least 1.2 times that of high molecular weight polymer (A), is dissolved in solvent to a concentration of from 5% by weight to 80% by weight, then spun and drawn.

2. Method for producing high-strength polyethylene fibres according to claim 1, characterized in that the high molecular weight polymer (A) is a polyethylene polymer comprising mainly ethylene component having a weight average molecular weight to number average molecular weight ratio (Mw/Mn) of no greater than 2.5 and an intrinsic viscosity [η] of from 10 to 40.

3. Method for producing high-strength polyethylene fibres according to claim 1, characterized in that the average intrinsic viscosity [η]M of the polymerization mixture is no less than 10 and the intrinsic viscosity [η]F of the resulting fibres satisfies the formula below $$0.6\times[\eta]M \leqq [\eta]F \leqq 0.9\times[\eta]M.$$

4. Method for producing high-strength polyethylene fibres according to claim 1, characterized in that the intrinsic viscosity [η]F of the resulting fibres satisfies the formula below $$0.7\times[\eta]M \leqq [\eta]F \leqq 0.9\times[\eta]M.$$

* * * * *